US005992280A

United States Patent [19]

Oishi et al.

[11] Patent Number: 5,992,280

[45] Date of Patent: Nov. 30, 1999

[54] PERFORATOR FOR METAL PLATE

[75] Inventors: Hirohiko Oishi; Sigemitsu Sone, both of Shizuoka, Japan

[73] Assignee: Fuji Photo Film Co., Ltd., Kanagawa, Japan

[21] Appl. No.: 08/847,812

[22] Filed: Apr. 25, 1997

Related U.S. Application Data

[62] Division of application No. 08/520,503, Aug. 28, 1995, abandoned, which is a division of application No. 08/162,706, Dec. 7, 1993, abandoned.

[30] Foreign Application Priority Data

Dec. 7, 1992 [JP] Japan ..... 4-326983

[51] Int. Cl.[6] ..... B26F 1/14

[52] U.S. Cl. ..... 83/55; 83/686; 72/334

[58] Field of Search ..... 83/686, 140, 139, 83/146, 282, 202, 682, 689, 55; 72/333, 334

[56] References Cited

U.S. PATENT DOCUMENTS

| | | |
|---|---|---|
| 389,404 | 9/1888 | O'Neill . |
| 770,239 | 9/1904 | Lovejoy . |
| 927,311 | 7/1909 | Anderson . |
| 1,166,613 | 1/1916 | Mackle . |
| 2,017,195 | 10/1935 | Anderson et al. . |
| 2,369,896 | 2/1945 | Harris et al. . |
| 2,372,011 | 3/1945 | Remington et al. . |
| 2,763,325 | 9/1956 | Willous . |
| 3,125,917 | 3/1964 | Smeets . |
| 3,143,026 | 8/1964 | Akerson . |
| 3,189,238 | 6/1965 | Sherrill . |
| 3,350,972 | 11/1967 | McKee . |
| 3,642,522 | 2/1972 | Gass et al. . |
| 3,724,305 | 4/1973 | Kondo . |
| 3,777,601 | 12/1973 | Strandell . |
| 3,889,563 | 6/1975 | Westermann . |
| 3,968,674 | 7/1976 | Ishida . |
| 4,143,569 | 3/1979 | Marconi . |
| 4,158,578 | 6/1979 | Komatsu et al. . |
| 4,526,077 | 7/1985 | DeGuvera . |
| 5,235,881 | 8/1993 | Sano et al. . |
| 5,410,927 | 5/1995 | Omata et al. . |
| 5,412,972 | 5/1995 | Congelliere . |
| 5,443,195 | 8/1995 | Sinn . |
| 5,492,001 | 2/1996 | Sasaki et al. . |
| 5,816,093 | 10/1998 | Takeuchi et al. ..... 72/327 |

FOREIGN PATENT DOCUMENTS

| | | |
|---|---|---|
| 0 329 172 | 8/1989 | European Pat. Off. . |
| 2 520 272 | 7/1983 | France . |
| 55-1941 | 1/1980 | Japan . |
| 61-241096 | 10/1986 | Japan . |
| 63-203223 | 8/1988 | Japan . |
| 3-053070 | 3/1991 | Japan . |
| 1122286 | 8/1968 | United Kingdom . |
| 1 282 282 | 7/1972 | United Kingdom . |

*Primary Examiner*—Kenneth E. Peterson
*Attorney, Agent, or Firm*—Young & Thompson

[57] ABSTRACT

A perforator for presensitized plate has plural punches and a die array cooperating with the punches. A stripper plate retains the plate adjacent the die array when punches separate from the die array after the punches form punched holes in the plate. The punches and/or the die array is coated with non-crystalline hard carbon. The punched holes are formed in the plate. In a preferred embodiment, the coating of the punches and/or die array has a surface whose roughness is 0.8 $\mu$m or less. A clearance defined between the punches and the die array is 10 to 30% of the thickness of the plate. Each advancing end of the punches is provided with a cylindrical tip portion of lesser width than the rest of the punch. The stripper plate is provided with a cushioning material mounted for contact with the plate.

1 Claim, 6 Drawing Sheets

PERFORATOR FOR METAL PLATE

This application is a division of application Ser. No. 08/520,503, filed Aug. 28, 1995, now abandoned which is a division of Ser. No. 08/162,706, filed Dec. 7, 1993, now abandoned.

BACKGROUND OF THE INVENTION

1. Field of the Invention

The present invention relates to a perforator, more particularly to a perforator for forming holes in metal plate material, such as a presensitized plate, which will be durable in use.

2. Description of the Prior Art

A lithographic printing system is generally operated by utilizing a preseuisitized plate (herein referred to as a PS plate), which comprises a support consisting of a thin metal plate of e.g. aluminum or steel. Such a PS plate processed for lithography is mounted in a printer. To position the PS plate precisely in the printer, the PS plate is provided with punched holes to receive positioning members.

In a manufacturing process for such PS plates, a perforator is used for punching the plate material. The perforator is a movable blade or punch shaped to punch a hole in order to pierce the plate material, and a stationary blade or die for slidably receiving the punch. The plate material is continuous or is a separate piece and is sandwiched between the punch and the die so as to punch holes in the plate material. Such a perforator is usable to punch simultaneously plural superposed pieces of material.

Good formation of punch holes which will be stable even after long use requires high quality of the punch and die of the perforator: the punch and die should be sufficiently hard, should have each blade precisely constructed, and should have sufficiently small roughness on the faces of the blades. It is usual to form the punch from high speed steel SKH, and to form the die from special tool steel SKD, and to set the roughness on the blade faces to be 20.0 $\mu$m, preferably as small as 1.0 $\mu$m. It is general to provide clearance between the punch and the die, of 5 to 8% of the thickness of the plate material to be punched.

In the course of repeated punching, finely powdered aluminum dust is generated from the plate material. The fine dust sticks on the blade faces, degrades the sharpness of the punching structure, and causes the punched edges to have irregularities, which are raised over the plate surface by contact with the punches when the punches are raised and removed from the punch holes. In view of this problem, it is proposed in Japanese Patent Laid-Open Publ. No. 61-241096 to superpose the metal plate material on light-shielding polyethylene-laminated lining paper and to punch the plate material from the side of the lining paper. The use of the polyethylene-laminated lining paper is somewhat effective in maintaining the sharpness of the punching structure, because the lining paper can wipe the fine dust off the blade faces.

Widespread use of polyethylene-laminated lining paper, however, could be harmful when discarded as industrial waste. Moreover, the mass production of PS plates can be counterproductive, in view of the public concern now shown for protection of the global environment against destruction caused by considerable wastes.

It might be better, for protecting PS plates from ambient light, to use polyethylene lining paper superposed on the PS plates. An experiment was conducted with thin aluminum plate with which polyethylene lining paper was used and which is 150 $\mu$m thick. The SKH-formed punches and/or the SKD-formed die had a roughness of 1.0 to 2.0 $\mu$m. A round punch hole 2 formed by the punches of a sheet perforation was 4 mm across, as illustrated in FIG. 10. In FIG. 11, a slot-like punch hole 3, formed by punches of a web perforator moving in the arrowed direction, was 10 mm long and 6 mm wide.

It has been observed that 10 to 20 times of operation of punching the plate material resulted in generation of an unwanted rise 5 or fold 6 around punch holes 2 and 3, because irregularities inside the punch holes 2, 3 are raised by the punches upon being retracted from the punch holes 2, 3. This lowers the quality of PS plates as products.

The use of such conventional perforators, after every 10 to 20 punching operations, requires inspection or cleaning of the blade faces. A problem lies in that there is a considerable limit to improving efficiency in punching out plate material.

SUMMARY OF THE INVENTION

In view of the foregoing problems, an object of the present invention is to provide a perforator of high performance and great durability.

Another object of the present invention is to provide a perforator avoiding the need for unwanted disposal of industrial waste.

In order to achieve the above and other objects and advantages of this invention retaining means retains the plate material in the die means while punch means separates from the die means after the punch means forms a hole in the plate material. The punch means and/or die means is coated with non-crystalline hard carbon.

In a preferred embodiment the coating of the punch means and/or die means has a surface of which the roughness is as low as 0.8 $\mu$m or less. The clearance between the punch means and the die means is up to 10 to 30% of the thickness of the plate material. Each advancing end of the punch means is provided with a cylindrical tip portion having a reduced width. The retaining means is provided with cushioning material mounted for contact with the plate material.

The novel perforator has high performance during perforating operations and durability over long use. Even when the punching operation is repeated, there is little dust generated from the plate material. No irregularities appear along the punched edges of the punched holes. Even after the punches are raised and removed from the punched holes, no unwanted raised edges or folds around the punched holes are generated, even upon repeated use of the novel perforator. The quality of PS plates as products is maintained without decreasing.

The use of the perforator does not require frequent inspection or cleaning of the blade faces. Efficiency of punching is greatly improved.

No harmful material is required for improving punching performance. Efficiency of operation can be raised without the need for disposal of substantial industrial wastes, as would be inconsistent with protection of the environment.

BRIEF DESCRIPTION OF THE DRAWINGS

The above objects and advantages of the present invention will become more apparent from the following detailed description when read in connection with the accompanying drawings, in which:

FIGS. 3A and 3B are views, in perspective, illustrating a punch and a die array of the perforator;

DETAILED DESCRIPTION OF THE PREFERRED EMBODIMENTS OF THE PRESENT INVENTION

Figure 1:
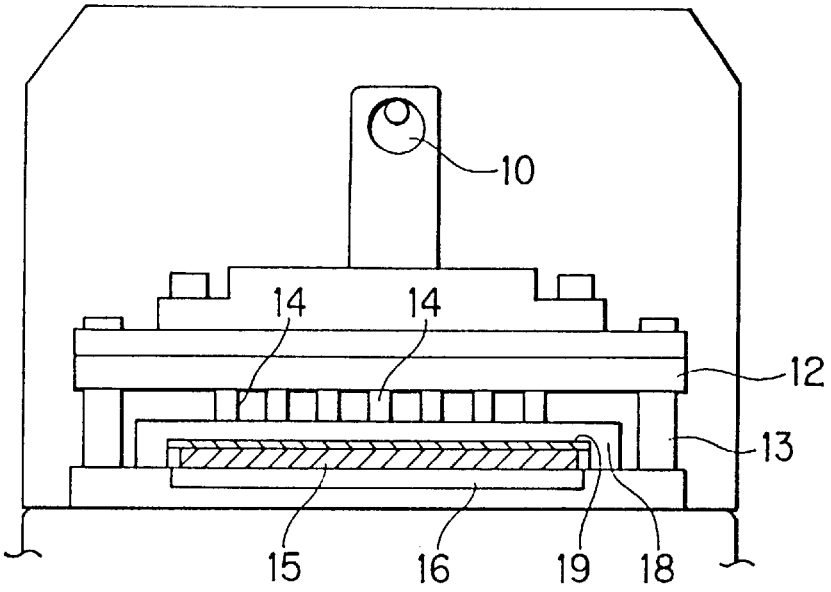
FIG. 1 is a view, in front elevation, illustrating a sheet perforator according to the present invention.

In FIG. 1 illustrating a sheet perforator according to the present invention, the sheet perforator has a drive mechanism 10 including a motor. A punch holder 12 is connected via a pair of guiding rods 13 to the drive mechanism 10, and is drivable to move up and down. On the punch holder 12 are arranged a number of, e.g. seven, punches 14 extending downward and formed e.g. from high speed steel SKH. A transport mechanism 9 (see FIG. 3) transports a rectangular thin flat metal sheet 15, and inserts it under the punches 14. The metal sheet 15 is placed on a die array 16 formed e.g. from special tool steel SKD. When the punch holder 12 is lowered, the punches 14 are inserted into the die array 16, until the punches 14 and the die array 16 cut the metal sheet 15 to form punch holes shaped to be round or elliptical.

Figure 2:
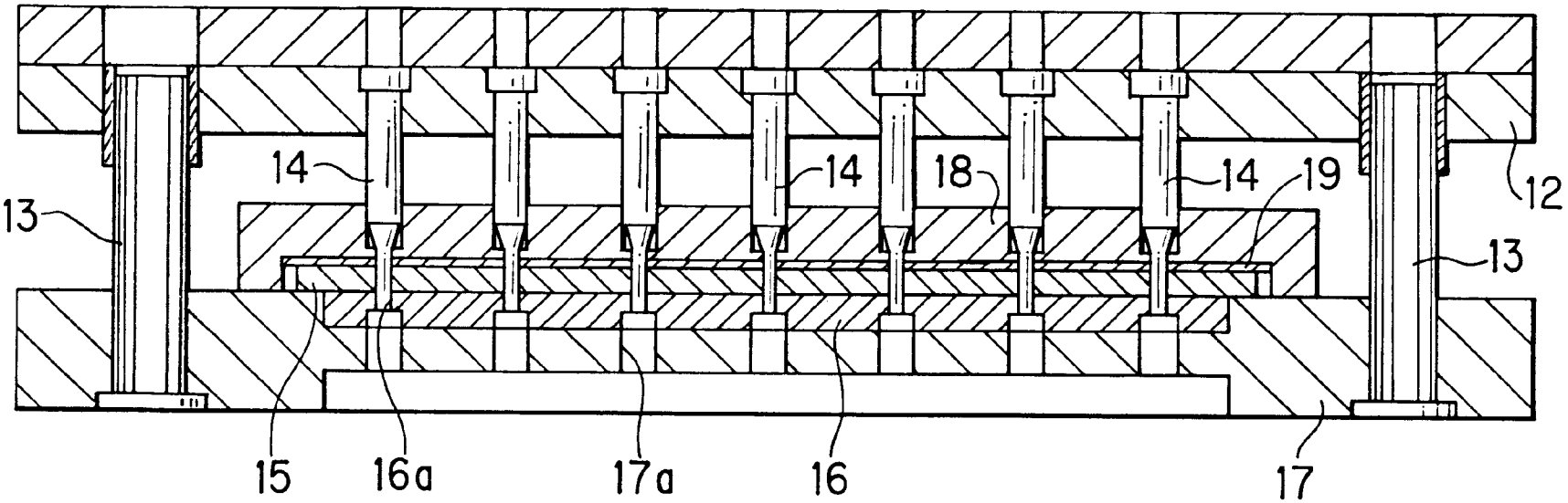
FIG. 2 is a cross section illustrating the perforator of FIG. 1.

In FIG. 2, the die array 16 has die holes 16*a* as,hose inner diameter or width is substantially equal to the width of the punch 14. The metal sheet 15 is punched when the die holes 16*a* receive the advancing punches 14. The die array 16 is supported on a die holder 17. After the metal sheet 15 is punched, the waste bits of the metal sheet 15 are discharged through openings 17*a*. A stripper plate 18 is disposed fixedly on the die array 16. The metal sheet 15 is inserted between the stripper plate 18 and the die array 16. When the punch holder 12 is raised after punching the metal sheet 15, the stripper plate 18 contacts the metal sheet 15, separates the rising punches 14 from the metal sheet 15, and keeps the metal sheet 15 from rising with the punches 14. The bottom of the stripper plate 18 has a cushioning material 19 for contact with the metal sheet 15. The cushioning material 19 consists of a sheet of polyethylene terephthalate (PET) 170 μm thick. Note that, after the punches 14 are retracted from the metal sheet 15, the transport mechanism 9 moves the metal sheet 15 from between the die array 16 and the punches 14.

Figure 5:
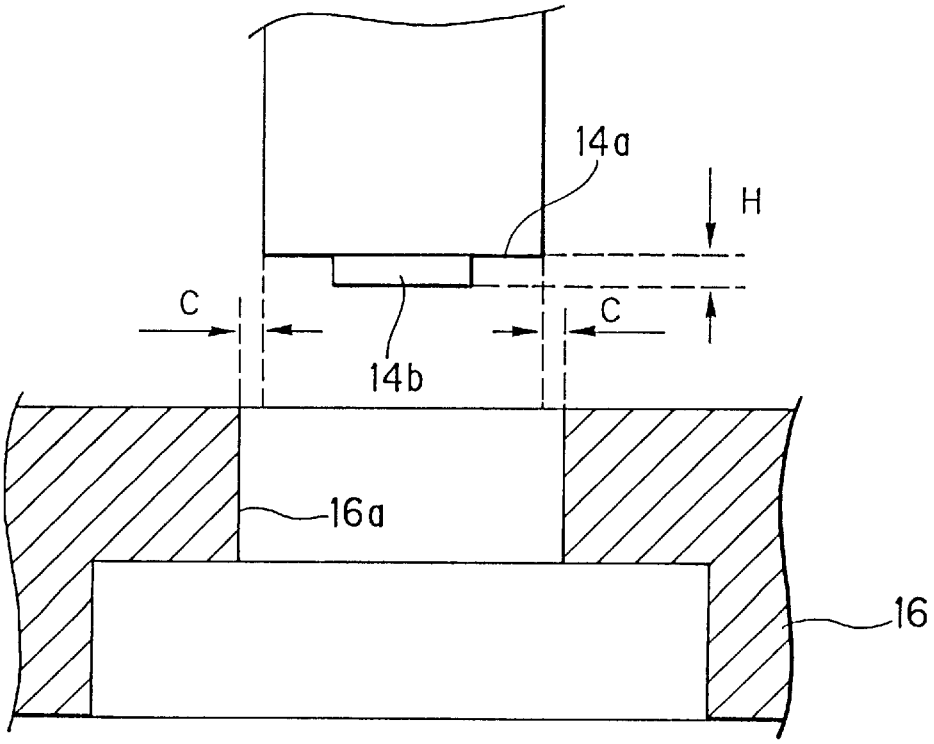
FIG. 5 is a view, in section, illustrating important sections of the punch and the die array.
Figure 3A:
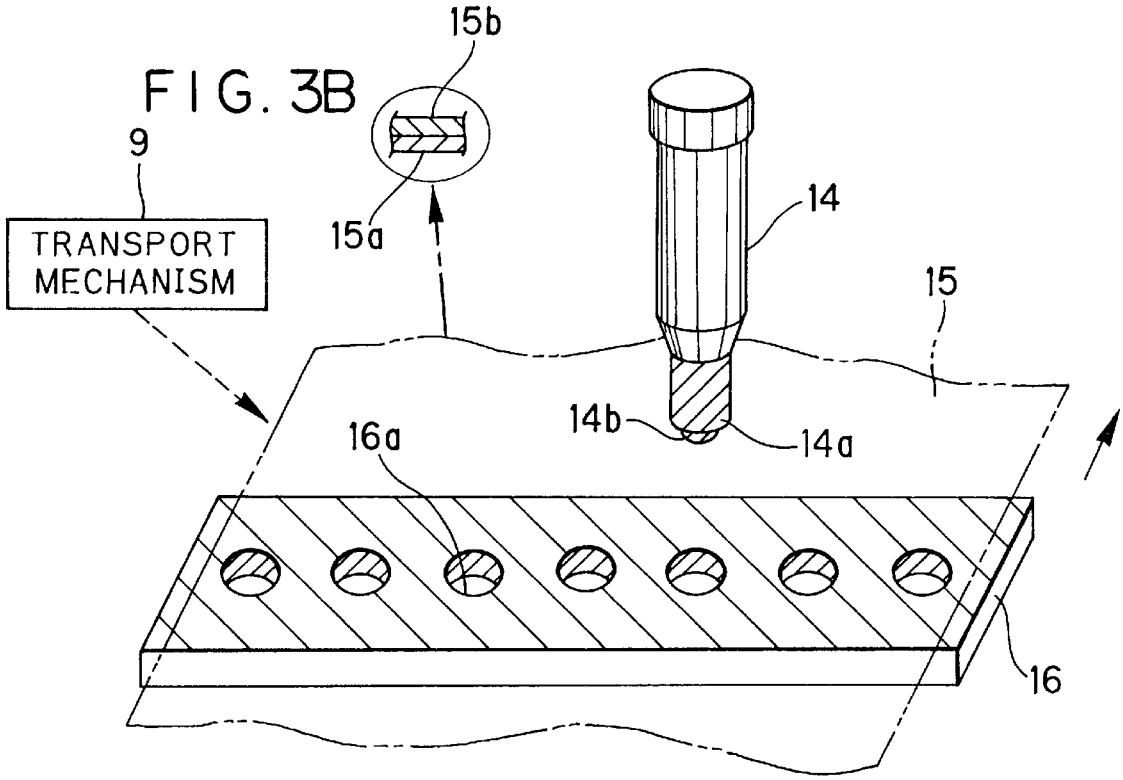
Figure 4:
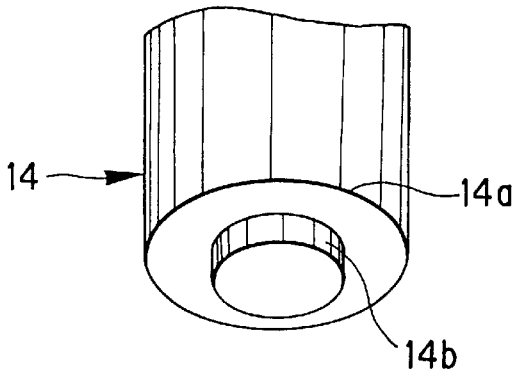
FIG. 4 is a perspective view illustrating a tip portion of the punch.

In FIGS. 3A and 3B illustrating the metal sheet 15, the punches 14 and the die array 16, the metal sheet 15 is constituted of a PS plate 15*a* and a light-shielding lining sheet 15*b* attached thereto. A punching blade edge 14*a* around the punches 14, the top face of the die array 16, and the inside of the die holes 16*a* is coated with non-crystalline hard carbon. Although either the punches 14 or the die array 16 may lack such a coating, it is preferred to coat both. The roughness of the carbon coat of those faces is 0.8 μm or less. As illustrated in FIGS. 4 and 5, the punches 14 each have a stepped tip portion 14*b* shaped as a cylinder smaller in diameter than the main body of the punch, thereby reducing the distortion or unwanted raised margin about the punched hole. The height H of the tip portion 14*b* is at least half the thickness of the metal sheet 15, and at most twice that thickness. There is a slight clearance between the punches 14 and the die holes 16*a*. The clearance C as shown is half of the difference between diameters of the punch 14 and the die hole 16*a*, and is in the range of 10 to 30% of the thickness of the metal sheet 15. Note that the perforator may lack the transport mechanism 9 and instead be fed manually.

Figure 6:
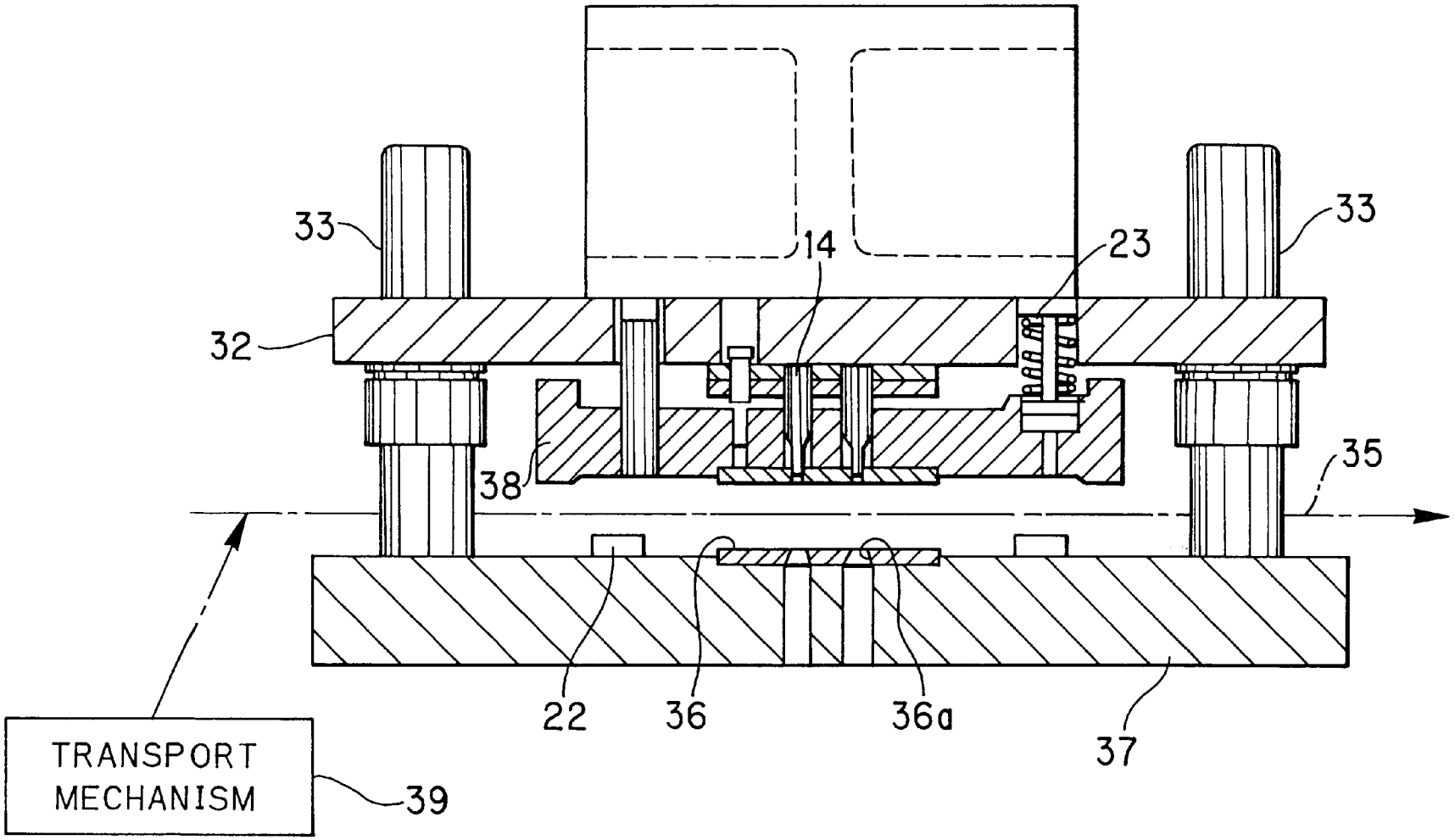
FIG. 6 is a cross-sectional view illustrating a web perforator.

FIG. 6 illustrates a preferred web perforator, in which a continuous web 35 constituted of PS plate and light-shielding lining paper is repeatedly punched in synchronism with the intermittent progressive conveyance of the web 35 by a transport mechanism 39. Elements similar to those of the sheet perforator in FIGS. 1 and 2 are designated with the identical numerals. In the web perforator, a stripper plate 38 is slidably mounted on a punch holder 32. When the punch holder 32 is lowered, the stripper plate 38 comes into contact with a stopper 22. Subsequently, the punch holder 32 is lowered against the bias of a stripper spring 23, until the punches 14 punch the web 35. After punching, the punch holder 32 with the punches 14 is raised, and the stripper plate 38 is raised. Note that reference numeral 33 designates guiding rods, 36 a die array, and 37 a die holder.

EXAMPLES

Figure 11:
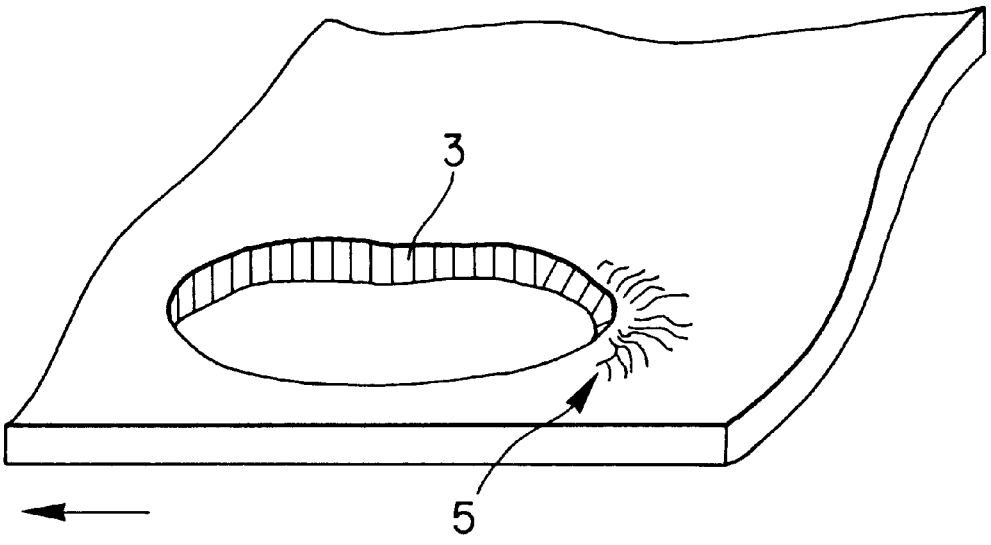
FIG. 11 (PRIOR ART)
FIG. 11 is a view illustrating damage around a slot-like punched hole formed by a conventional web perforator.

An experiment was conducted with the web 35 in which lining paper was attached to the PS aluminum plate. The lining paper was of polyethylene. The web perforator in FIG. 6 was used, of which the carbon coat had a roughness of 0.8 μm or less, as described above. The clearance C between the punches 14 and the die holes in the die array 36 was 10% of the thickness of the web 35. The experiment resulted in punched holes that were regular and of good shape, even after 5,000 punching operations of the web perforator: and this is a success when compaired with a conventional perforator, in which 100 to 500 operations of punching the same web 35 resulted in generation of an unwanted raised portion 5 on the periphery of punch holes 3, as illustrated in FIG. 11.

Another experiment was conducted. Three metal sheets 15, each of polyethylene lining paper 15*b* attached to PS aluminum plates 15*a*, were superposed, and were loaded together into the sheet perforator in FIGS. 1 and 2 as described above. The experiment resulted in punched holes of regularly good shapes, even after 50,000 repetitions of the punching operation of the sheet perforator: and this is again a success as compared with a conventional perforator, in which 60 operations of punching round holes in the same metal sheet 15 resulted in generation of improperly shaped punched holes, because the punches and die holes had worn until they were dull.

Still another experiment was conducted with the superposed three sheets of metal sheets 15 inclusive of PS aluminum plates 15*a* attached to lining sheets 15*b* produced all from pulp. Each of the PS plates 15*a* was 150 μm thick. The sheet perforator of FIGS. 1 and 2 was used. The punches 14 each had a cylindrical tip portion 14*b* . The punches 14 and/or the die holes 16*a* were coated with the carbon as above, which had a roughness of 0.8 μm or less. The clearance C defined between the punches 14 and the die holes 16*a* was 20% of the thickness of the thin plate. The bottom of the stripper plate 18 had thereon cushioning material 19, which was polyethylene terephthalate cushioning material 19, 170 μm thick. The punches 14 were 4.0 mm across. The tip portion 14*b* was 2.0 mm across and 0.2 mm high.

The experiment resulted in punched holes of good shape with only small raised margins and without damage, even after 5,000 punching operations of the sheet perforator. Very little powder from the tin plate stuck to the punching blade edges. The performance of the sheet perforator when punching the metal sheets with pure pulp lining paper was equal to or better than that when punching the metal sheets with the polyethylene lining paper. This was a success as compared with a conventional perforator, in which 10 to 20 times of operation of punching the same thin plate resulted in generation of unwanted raised borders around punched holes by an amount twice as great as the novel sheet perforator.

Figure 7:
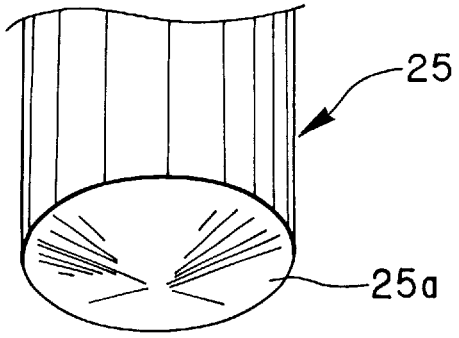
FIGS. 7 to 9 are views similar to FIG. 4 but illustrating respective tip portions of other preferred punches.
Figure 8:
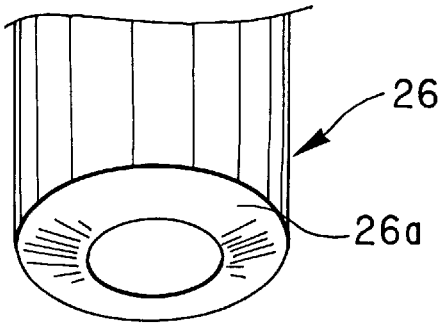
Figure 9:
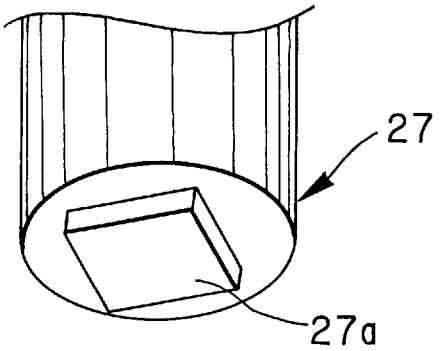
Figure 10:
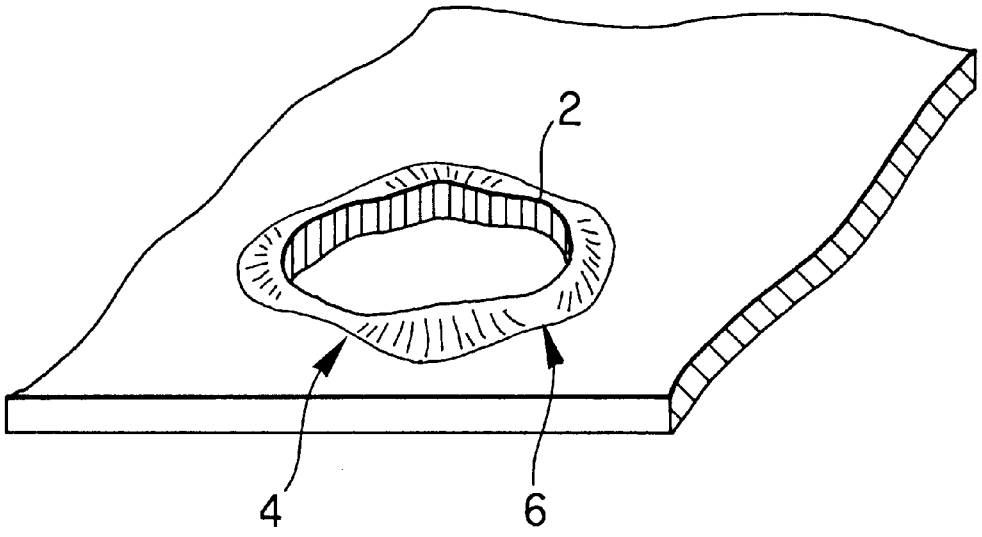
FIG. 10 (PRIOR ART)
FIG. 10 is a view illustrating damage around a round punched hole formed by a conventional sheet perforator.

Note that the punches and die array to be used in the present invention can be formed, not only from the high speed steel SKH or the special tool steel SKD above described, but from sufficiently hard other steels, such as various high speed steels and high speed steel powder. It is also possible to construct punches differently: the punch 25 in FIG. 7 has a conical tip portion 25*a*; the punch 26 in FIG. 8 has a truncated conical tip portion 26*a*; and the punch 27 in FIG. 9 has a quadrangular stepped tip portion 27*a*.

Note that, although the punched holes formed in the above embodiments are round, alternatively punched holes shaped like slots having round corners can be formed, by use of punches shaped correspondingly. Although the metal sheets and web constitute PS aluminum plates in tile above embodiment, the present invention is applicable to punching PS steel plates.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

What is claimed is:

1. A method for forming a hole in a metal plate, comprising positioning an imperforate metal plate between a movable punch means and a die means cooperating with said movable punch means, said punch means being elongated and having a longitudinal axis and having a first flat lower end surface perpendicular to said axis, a stepped tip portion centered on said axis and comprising a cylinder smaller in diameter than said first flat surface and centered in and projecting below said first flat surface and having a length along said axis which is less than a diameter of said cylinder, said cylinder having a second flat lower end surface, said die means having an internal diameter greater than the greatest diameter of said punch means, advancing said punch means toward said imperforate plate, said second flat lower end surface contacting said imperforate material plate first, and said first flat lower end surface contained said imperforate second, said punch means continuing through said imperforate metal plate to punch out from said imperforate plate a hole having a diameter at least as great as said greatest diameter of said punch.

* * * * *